United States Patent [19]

Hedstrom et al.

[11] Patent Number: 4,781,235

[45] Date of Patent: Nov. 1, 1988

[54] COMBINED SUN SCREEN AND STORM WINDOW

[76] Inventors: Kurt B. Hedstrom, 1604 Meredith Pl., Plant City, Fla. 33566; Iver H. Hedstrom, 5180 Elwood Rd., Springhill, Fla. 33512

[21] Appl. No.: 46,429

[22] Filed: May 6, 1987

[51] Int. Cl.[4] ..... E06B 9/17

[52] U.S. Cl. ..... 160/269; 160/26

[58] Field of Search ..... 160/269, 268 R, 271, 160/272, 273 R, 26

[56] References Cited

U.S. PATENT DOCUMENTS

| | | | |
|---|---|---|---|
| 496,364 | 4/1893 | Laurie . | |
| 1,235,769 | 8/1917 | Damm . | |
| 1,351,350 | 9/1920 | Burns . | |
| 1,672,648 | 6/1928 | Lenish . | |
| 1,713,989 | 5/1929 | Warnick | 160/269 |
| 1,751,950 | 3/1930 | Sacerdote . | |
| 2,065,813 | 12/1936 | Lang . | |
| 2,084,847 | 6/1937 | Kaletay . | |
| 2,886,103 | 5/1959 | Pitcoff | 160/269 |
| 3,237,682 | 3/1966 | Davis | 160/269 |
| 4,126,174 | 11/1978 | Moriarty . | |
| 4,246,952 | 1/1981 | Helldorfer . | |
| 4,282,919 | 8/1981 | Teno . | |
| 4,333,511 | 6/1982 | Johnston . | |
| 4,369,829 | 1/1983 | Casiday | 160/269 X |

FOREIGN PATENT DOCUMENTS

| | | | |
|---|---|---|---|
| 1127960 | 7/1982 | Canada | 160/269 |
| 1534864 | 12/1978 | United Kingdom . | |

*Primary Examiner*—Ramon S. Britts
*Assistant Examiner*—David M. Purol
*Attorney, Agent, or Firm*—Fleit, Jacobson, Cohn & Price

[57] ABSTRACT

A combined sun screen and storm window in the form of a vertical, generally rectangular frame having a flexible panel of sheet material retractably supported by a spring biased roller at the upper end of the frame and connected to a slide at its free end with a pair of guide strips being provided on the frame for each edge of the panel and slide with one of each pair of guide strips at the opposite side edges of the panel being movable toward and away from the other strip for clampingly engaging the side edges of the panel and slide. The strips are provided with weather stripping along the inner surfaces thereof to provide waterproof and substantial by air impervious construction to enable the panel to be used as a sun screen or storm window.

6 Claims, 1 Drawing Sheet

COMBINED SUN SCREEN AND STORM WINDOW

BACKGROUND OF THE INVENTION

1. Field of the Invention

The present invention generally relates to a combined sun screen and storm window in the form of a vertical, generally rectangular frame having a flexible panel of sheet material retractably supported by a spring biased roller at the upper end of the frame and connected to a slide at its free end with a pair of guide strips being provided on the frame for each edge of the panel and slide with one of each pair of guide strips at the opposite side edges of the panel being movable toward and away from the other strip for clampingly engaging the side edges of the panel and slide. The strips are provided with weather stripping along the inner surfaces thereof to provide waterproof and substantially air impervious construction to enable the panel to be used as a sun screen or storm window.

2. Information Disclosure Statement

Various efforts have been made to provide a roll-up type of storm window in which the panel forming the storm window is secured in an extended closed position and mounted on a roller for movement to a retracted open position. However, the prior art in this field of endeavor does not include the specific arrangement disclosed in this application. A separate information disclosure statement will be filed.

SUMMARY OF THE INVENTION

An object of the present invention is to provide a combined sun screen and storm window which includes a generally rectangular frame oriented in a vertical position and having a flexible panel of sheet material supported therein by a spring biased roller at the upper end thereof and a slide at the free edge for movement in a vertical direction between a lowered closed position and a raised open position with the side edges of the frame including a guide structure, clamping structure and sealing structure for the slide and panel when in the closed or lowered position.

Another object of the invention is to provide a combined sun screen and storm window in accordance with the preceding object in which the guide structure along each side of the frame includes a pair of vertically extending strips having weather seals on the inner surfaces thereof and which are spaced apart to guidingly receive the end edges of the slide and the side edges of the panel during vertical movement with one of the strips in each pair being movable toward and away from the other strip in each pair for clamping and sealing engagement with the panel and slide to retain the panel in vertically lowered position and permit it to move between lowered closed position and raised open position.

A further object of the invention is to provide a combined sun screen and storm window in accordance with the preceding object in which the structure for movement of the laterally movable strip includes an angled cam slot and pin received in the slot which causes the strip to be moved laterally upon lengthwise movement of the cam slot.

A still further object of the invention is to provide a combined sun screen and storm window in accordance with the preceding object in which the pin is on a strap connected to the movable strip and the cam slot is in a strap slidable on the stationary strip with a handle being connected to the strap having the cam slot for movement thereof.

Still another object of the invention is to provide a combined sun screen and storm window in accordance with the preceding objects in which the movable strip is outermost in relation to the frame and the moving cam structure is effective for moving the strips to establish a close contacting sealed engagement between the weather strip surfaces on the strips and the panel and slide.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a detailed sectional view taken along section line 2—2 of FIG. 1 illustrating the movable strip in spaced relation to the stationary strip to form a guide for the slide and panel.

DESCRIPTION OF THE PREFERRED EMBODIMENT

Figure 1:
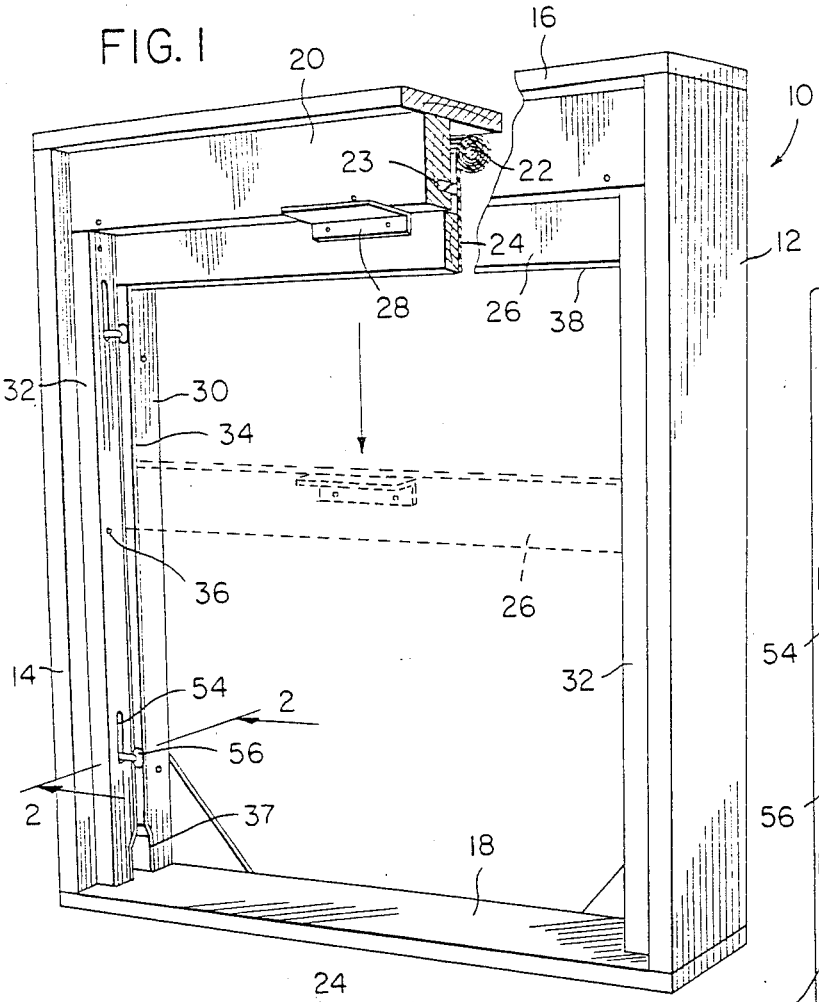
FIG. 1 is a perspective view of the sun screen and storm window of the present invention with portions broken away illustrating the supporting roller and weather stripping at the upper end of the device.

Referring now specifically to the drawings, the combined sun screen and storm window of the present invention is generally designated by reference numeral 10 and is in the form of a generally rectangular frame with upright side members 12 and 14 rigidly interconnected by a top member or header 16 and a bottom member or sill 18. Below the header 16, a pair of frame members 20 are provided which conceal a spring roller 22 rotatably supported in a suitable manner between the side members 12 and 14 in order to support a flexible panel of sheet material 24 having a slide 26 at the free end thereof with a handle 28 being provided optionally on the slide 26 so that the panel 24 can be moved from a raised open position to a lowered closed position by unwinding from or winding onto roller 22 as indicated by the broken line illustration in FIG. 1.

Figure 2:
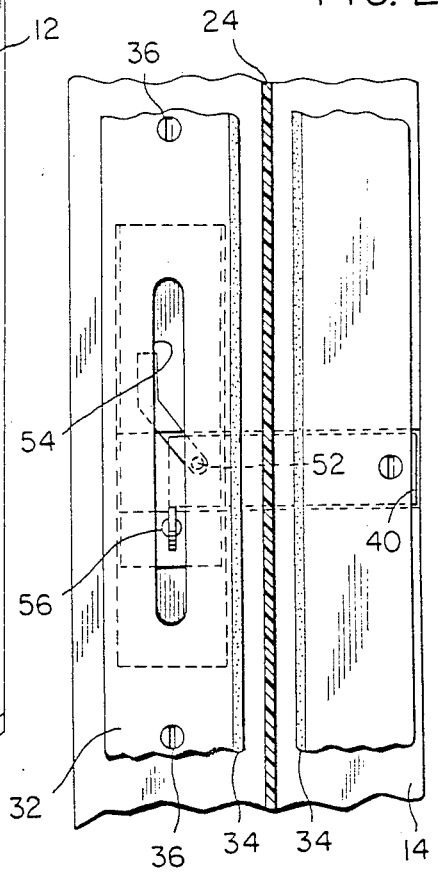

Each side member 12 and 14 is provided with a pair of vertical strips 30 and 32 which are of substantially identical construction and are in spaced parallel relation with the inner surface of each strip 30 and 32 having weather stripping 34 thereon. The strip 32 is laterally stationarily supported by suitable fasteners 36 while the strip 30 is laterally movably supported for movement toward and away from the strip 32. When the strips 30 and 32 are spaced apart, as illustrated in FIG. 2, the weather stripping 34 and the strips 30 and 32 form guide slots for the side edges of the panel 24 and the end edges of the slide 26. When the slide 26 has been completely lowered, the movable strip 30 may then be moved toward the stationary strip 32 for clamping and sealing engagement with the opposed surfaces of the side edges of the panel 24 and the slide 26 with the lower end portions of the inner edges of each of the strips 30 and 32 being notched or recessed as at 37 for conforming with the external contour of the slide 26 so that when the slide 26 is lowered, weather stripping 38 on the lower edge thereof will engage the window sill 18 and the weather stripping 34 along the inner edges of the strips 30 and 32 including the recesses 36 at the lower edges thereof will clampingly and sealingly engage the slide and the flexible panel 24 throughout the length of its side edges thereby providing an effective storm window with the upper edge portion of the flexible panel 24 being sealed by weather stripping 23 on the inner surface of the inner frame members 20 that engages transversely across the flexible panel inner surface at the upper ends of the weather stripping 34 when the movable strips 30 are moved into clamping and sealing engagement with the side edges of panel 24 thus forming a peripheral seal between the frame and flexible panel 24 for effective use as a storm window. By constructing the flexible panel 24 with various degrees of light transmissivity or occlusion, the flexible panel 24 may also be effective as a sun screen. One material which lends itself well to the construction of the flexible panel is mylar which has the capability of maintaining a high degree of flexibility during various temperature conditions and is resistant to deterioration from sun and other weather conditions.

Figure 3:
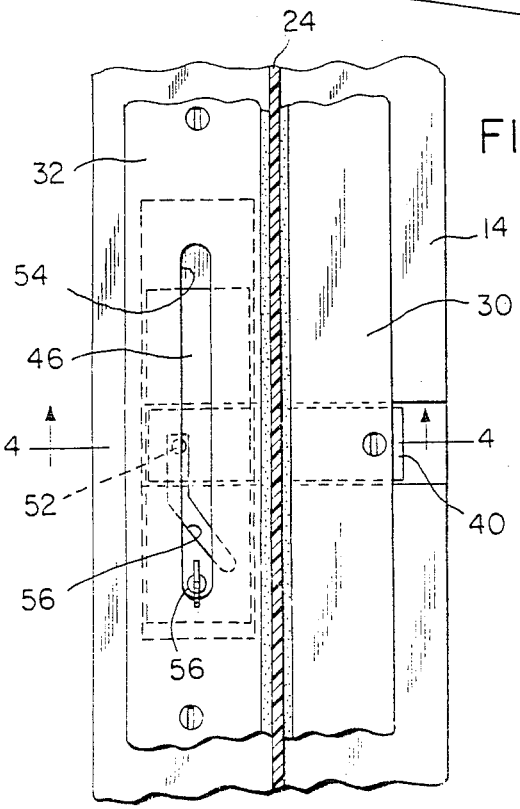
FIG. 3 is a fragmental view similar to FIG. 2 but illustrating the mechanism for moving the movable strip actuated to move the strip into contacting relation with the edge of the panel.
Figure 4:
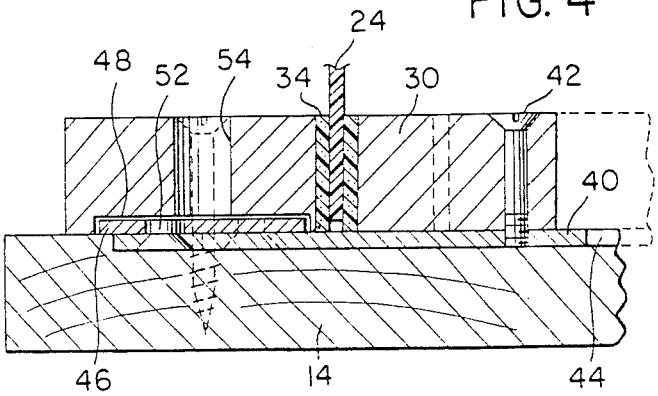
FIG. 4 is a sectional view taken substantially upon a plane passing along section line 4—4 illustrating the relationship of the pair of strips and the actuating mechanism for the movable strip.

The structure for moving the movable strip 30 in relation to the stationary strip 32 is illustrated in FIGS. 2–4 and includes a metal strap 40 secured to the exterior surface of the strip 30 by a fastener 42 as illustrated in FIG. 4 with the strap 40 being slidably received in a horizontal recess 44 in the side frame 14. In perpendicular relation to the inner end of the strap 40, a vertical metal strap 46 is received in a vertical recess 48 in the inner surface of strip 32 with the strap 46 being disposed in perpendicular relation and slidably in relation to the inner surface of the strap 40 as illustrated in FIGS. 2–4. The vertical strap 46 is provided with an angulated cam slot 50 therein which intersects the strap 40 and receives a projecting pin 52 that is rigid with the strap 40. Thus, when the strap 46 is moved vertically in relation to the strap 40, the pin 52 will ride in the cam slot 50 thus causing the strap 40 and strip 30 to move laterally inwardly or outwardly. When the pin 52 is at the bottom of the cam slot 50 as illustrated in FIG. 2, the strip 30 is spaced from the strip 32 but when the pin 52 is at the upper end of the cam slot 50 as illustrated in FIG. 3, the strip 30 is moved toward the strip 32. As illustrated in FIG. 1, the strip 32 includes a slot 54 associated with each of the actuating mechanisms which are located adjacent the upper and lower ends of the frame with each of the slots 54 receiving an actuating handle 56 therethrough which is in the form of a wing-type thumb screw so that the screw and strap 46 may be moved vertically. All of the actuating mechanism is located to the interior of the frame and enables the mechanism to be operated from the interior of a window opening or the like. The thumb screw or handle 56 may be threaded through the vertical strap 46 for engaging the underlying surface of the strip or frame for locking the vertical movable strap 46 in either the lowered or raised position or in the clamped or released position.

The structure of the present device enables effective operation of the flexible sun screen or storm window which may be constructed of mylar or other similar material that will maintain its flexibility and any desired capability of water imperviousness, air imperviousness and may be decorated if desired with any type of decorative material incorporated into the flexible panel so that the thickness remains the same and the flexibility thereof remains the same. The side edges of the flexible panel and the end edges of the rigid slide at the lower edge thereof are effectively guided by the spaced strips 30 and 32 with the weather stripping cushioning the movement of these components between raised and lowered positions. When the slide has been completely lowered and the flexible panel is in closed position, the outermost strips 30 may be individually moved inwardly by movement of the screw handle for each of the vertical actuating straps or bars 46 which causes inward movement of the strap 40 and thus inward movement of the strip 30 into clamping engagement and sealing engagement with the side edges of the panel and the surfaces of the slide which is disposed in the notches 37 at the lower end of the strip which together with the weather strip 23 at the top edge of the frame engaging the panel forms a complete peripheral weather stripping and substantial seal for the flexible panel to enable the device to effectively operate as a storm window. The structure for moving the strip is easy to manipulate and is positive in operation and will have a long life expectancy without any maintenance.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A combined sun screen and storm window comprising a generally rectangular frame having parallel side members, a top header and a bottom sill, each side member including a pair of guide strips with the strips being spaced from each other, a flexible panel supported on a spring biased roller at the upper end thereof and provided with a slide on the free end thereof for vertical movement between the strips with the strips forming guides for the slide and side edges of the panel, one of said strips in each pair being movably supported for clamping and sealing engagement with the opposed side edge surfaces of the panel and the opposed end surfaces of the slide, and means moving the movable strip and retaining it is adjusted position, said means for moving the movable strip including a strap attached fixedly to the movable strip and extending laterally into overlapping relation to the stationary strip, a movable strap mounted on the stationary strip in intersecting relation to the strap attached to the movable strip with a cam slot on the movable strap on the stationary strip with a pin on the strap on the movable strip received in the cam slot whereby movement of the strap with the cam slot therein will laterally move the strap attached to the movable strip, thereby moving the movable strip between clamped and unclamped positions.

2. The structure as defined in claim 1 wherein the means for moving the movable strip includes a screw threaded thumb screw on the movable strap on the stationary strip and the stationary strip including a slot receiving the thumb screw, said thumb screw locking the vertically movable strap on the stationary strip in adjusted position for maintaining the movable strip in adjusted position.

3. A closure device comprising a rigid frame having generally parallel side members and parallel end members perpendicular to the side members, a spring biased roller rotatably supported adjacent to and generally parallel to one of said end members, a flexible panel wound on said roller and including a free edge movable toward and away from the opposite end member when the panel is unwound from and wound on said roller, each of said side members including a pair of guide members oriented in spaced relation and movably receiving a side edge of the panel, and means mounting at least one of said guide members of each pair on the side member for movement toward and away from the other guide member in each pair for clamping the side edges of the panel for retaining it in adjusted position, said means mounting the movable guide members including a strap rigid with the movable guide member and extending into intersecting relation to the other guide member of the pair, a strap slidably mounted on said other guide member in generally perpendicular relation to the strap on the movable guide member, and a pin and cam slot connection between said strap whereby sliding movement of the straps on said other guide member will move the movable guide member toward and away from the other guide member.

4. The closure device as defined in claim 3 wherein said free edge of the panel includes a substantially rigid member having end edges received between said guide members and forming means by which the free end of panel can be more effectively grasped when extending or retracting the panel.

5. The closure device as defined in claim 4 wherein each of said guide members includes a longitudinally continuous strip, a longitudinally continuous weather strip on the inner edge of each strip to sealingly engage opposite surfaces of the side edges of the panel, said rigid member on the free end of the panel including a continuous weather strip thereon for sealing engagement with the opposite end member of the frame when the panel is fully extended, said frame including a continuous weather strip supported therefrom for engaging a transverse surface of the panel when the side edges of the panel are engaged and clamped by said movable guide members thereby forming a seal peripherally of the panel when in extended position.

6. The closure device as defined in claim 3 wherein said slidable strap includes a laterally extending handle, said slidable strap being mounted interiorly of said other guide member, said other guide member including a slot through which the handle on the slidable strap extends to enable the handle to be grasped on manipulated by movement in the slot, said handle being in the form of a screw threaded member screw threadedly extending through the slidable plate for engaging an underlying surface to lock the slidable strap in adjusted position to maintain the movable strip in adjusted position.

* * * * *